US011018462B2

(12) United States Patent
Akagi et al.

(10) Patent No.: US 11,018,462 B2
(45) Date of Patent: May 25, 2021

(54) CONNECTOR FOR VEHICLE

(71) Applicant: Yazaki Corporation, Tokyo (JP)

(72) Inventors: Yosuke Akagi, Shizuoka (JP); Shingo Hamada, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/842,015

(22) Filed: Apr. 7, 2020

(65) Prior Publication Data

US 2020/0321738 A1 Oct. 8, 2020

(30) Foreign Application Priority Data

Apr. 8, 2019 (JP) ..... JP2019-073344

(51) Int. Cl.
*H01R 13/74* (2006.01)
*H01R 13/506* (2006.01)
*H01R 13/52* (2006.01)

(52) U.S. Cl.
CPC ..... *H01R 13/74* (2013.01); *H01R 13/506* (2013.01); *H01R 13/5202* (2013.01); *H01R 13/5205* (2013.01); *H01R 13/743* (2013.01)

(58) Field of Classification Search
CPC .. H01R 13/74; H01R 13/506; H01R 13/5202; H01R 13/743; H01R 13/5205
See application file for complete search history.

(56) References Cited

U.S. PATENT DOCUMENTS 3,753,212 A * 8/1973 Yamada ..... H01R 13/514 439/358
5,775,944 A * 7/1998 Flask ..... H01R 13/743 439/556
6,835,094 B2 * 12/2004 Matsushita ..... H01R 13/5202 439/271
6,848,938 B2 * 2/2005 Miyamoto ..... H01R 13/743 439/556
8,029,305 B2 * 10/2011 Tanaka ..... H01R 13/193 439/345
9,806,453 B2 * 10/2017 Matsuura ..... H01R 13/50
2010/0130050 A1 5/2010 Tanaka

FOREIGN PATENT DOCUMENTS

JP 2010-129256 A 6/2010

* cited by examiner

*Primary Examiner* — Tho D Ta
(74) *Attorney, Agent, or Firm* — Sughrue Mion, PLLC

(57) ABSTRACT

A connector includes a panel, a first housing assembled to the panel, and a second housing fittable to the first housing. A grommet covers the outer circumference of the second housing and has a lip to be brought into close contact with the panel. A flange is provided movably on the outer circumference of the second housing. The flange is regulated in movement with respect to the second housing with the lip away from the panel. A fitting detection mechanism enables the flange to move toward the panel and enables the lip to come in close contact with the panel, with the first housing and the second housing fitting normally together.

3 Claims, 14 Drawing Sheets

CONNECTOR FOR VEHICLE

BACKGROUND

Technical Field

The present disclosure relates to a connector for a vehicle. Particularly, the present disclosure relates to a connector including a housing assembled to a panel and a housing covered with a grommet, in which the housings fit together.

Related Art

There is a connector including a first housing assembled to a panel, a second housing fittable to the first housing, and a grommet covering the outer circumference of the second housing, the grommet having an elastic sealing piece as a lip to be brought into close contact with the panel (refer to JP 2010-129256 A).

In the connector, a flange for assembly with the grommet, on the outer circumference of the second housing, is provided integrally with the second housing, the first housing is assembled to the panel, and the grommet is assembled to the flange of the second housing.

According to the connector as above, fitting of the second housing to the first housing causes the elastic sealing piece of the grommet assembled to the flange of the second housing, to come in close contact with the surface of the panel. Thus, the side of the first housing and the side of the second housing are partitioned with respect to the panel.

SUMMARY

However, according to the connector, because the lip of the grommet covering the outer circumference of the second housing is in close contact with the panel with the first housing and the second housing fitting together, the fitting state between the first housing and the second housing is difficult to verify visually.

Thus, for detection of the fitting state between the first housing and the second housing, after fitting of the first housing and the second housing, the second housing needs to be pulled in the direction away from the first housing. Thus, detection of the fitting state is troublesome.

Therefore, an object of the present disclosure is to provide a connector enabling easy detection of the fitting state between a first housing and a second housing.

According to one aspect of the present disclosure, provided is a connector including: a first housing assembled to a panel; a second housing fittable to the first housing; a grommet covering an outer circumference of the second housing, the grommet having a lip to be brought into close contact with the panel; a flange arranged movably on the outer circumference of the second housing, the flange being assembled with an adjacent portion to the lip in the grommet, the flange being regulated in movement with respect to the second housing with the lip away from the panel; and a fitting detection mechanism enabling the flange to move toward the panel and enabling the lip to come in close contact with the panel, with the first housing and the second housing fitting normally together.

The connector includes the fitting detection mechanism enabling the flange to move toward the panel and enabling the lip to come in close contact with the panel, with the first housing and the second housing fitting normally together. Thus, the flange is movable toward the panel in the normal fitting state between the first housing and the second housing, but the flange is immovable to the panel with the first housing and the second housing not fitting normally together.

Therefore, the connector as above enables detection of the fitting state between the first housing and the second housing based on whether the flange moves. Thus, the fitting state between the first housing and the second housing can be easily detected.

In the configuration, an engaging portion and an engaged portion may be provided between the second housing and the flange, the engaging portion being deformable, the engaged portion engaging with the engaging portion, the engaged portion regulating the movement of the flange with respect to the second housing, and the fitting detection mechanism may have a releasing member that deforms the engaging portion to release the engagement between the engaging portion and the engaged portion, with the first housing and the second housing fitting normally together.

In the connector, the fitting detection mechanism may have the releasing member that deforms the engaging portion to release the engagement between the engaging portion and the engaged portion, with the first housing and the second housing fitting normally together. Thus, movement of the flange with respect to the second housing can be reliably controlled on the basis of whether the engagement between the engaging portion and the engaged portion is released by the releasing member.

In the configuration, the releasing member may be arranged movably between the first housing and the second housing, and moves due to fitting of the first housing and the second housing.

In the connector, the releasing member may be arranged movably between the first housing and the second housing, and moves due to fitting of the first housing and the second housing. Thus, the releasing member can reliably release the engagement between the engaging portion and the engaged portion, in accordance with the fitting state between the first housing and the second housing.

DETAILED DESCRIPTION

Figure 1:
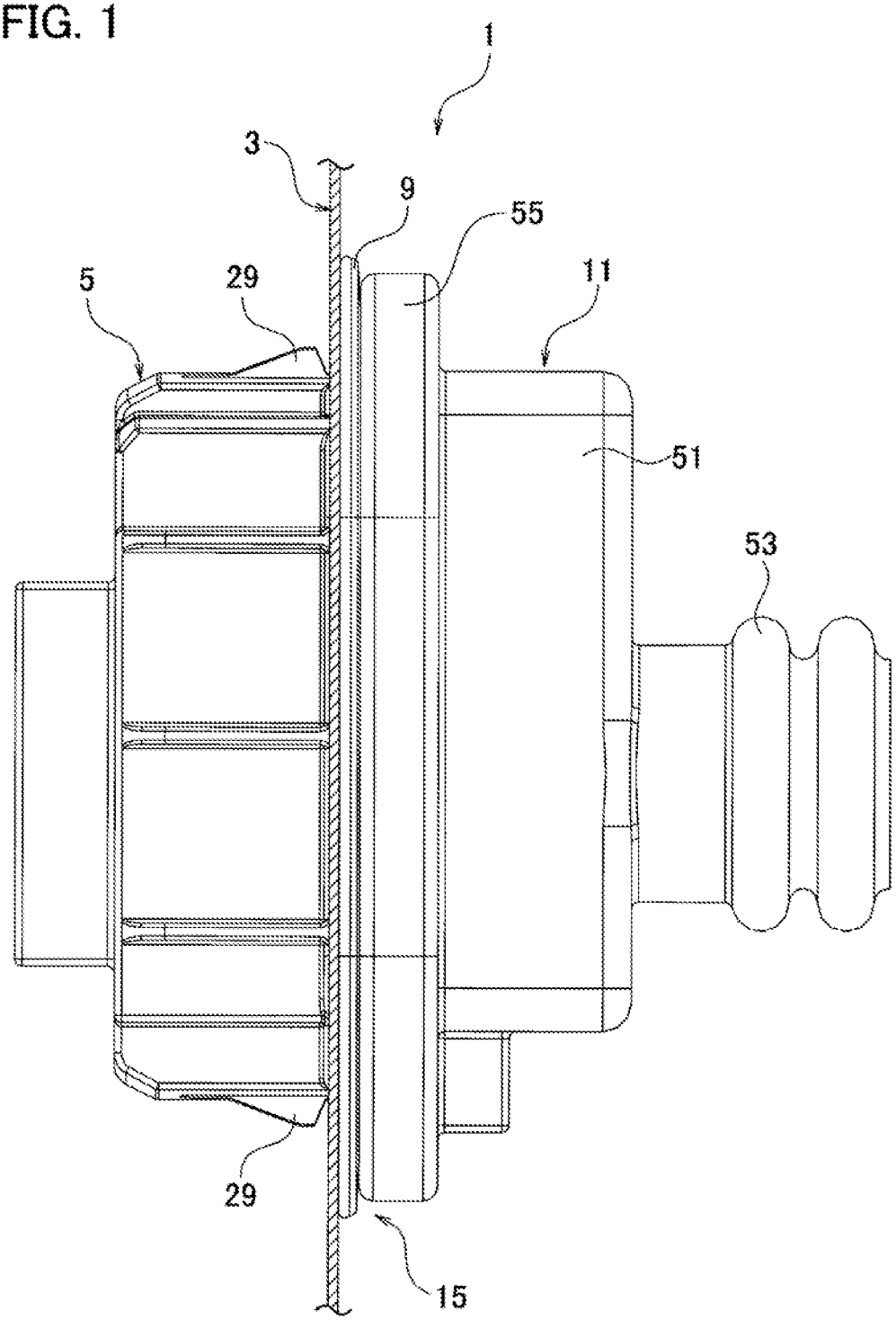
FIG. 1 is a side view of a connector according to an embodiment of the present disclosure, in which a first housing and a second housing have fitted normally together.
Figure 2:
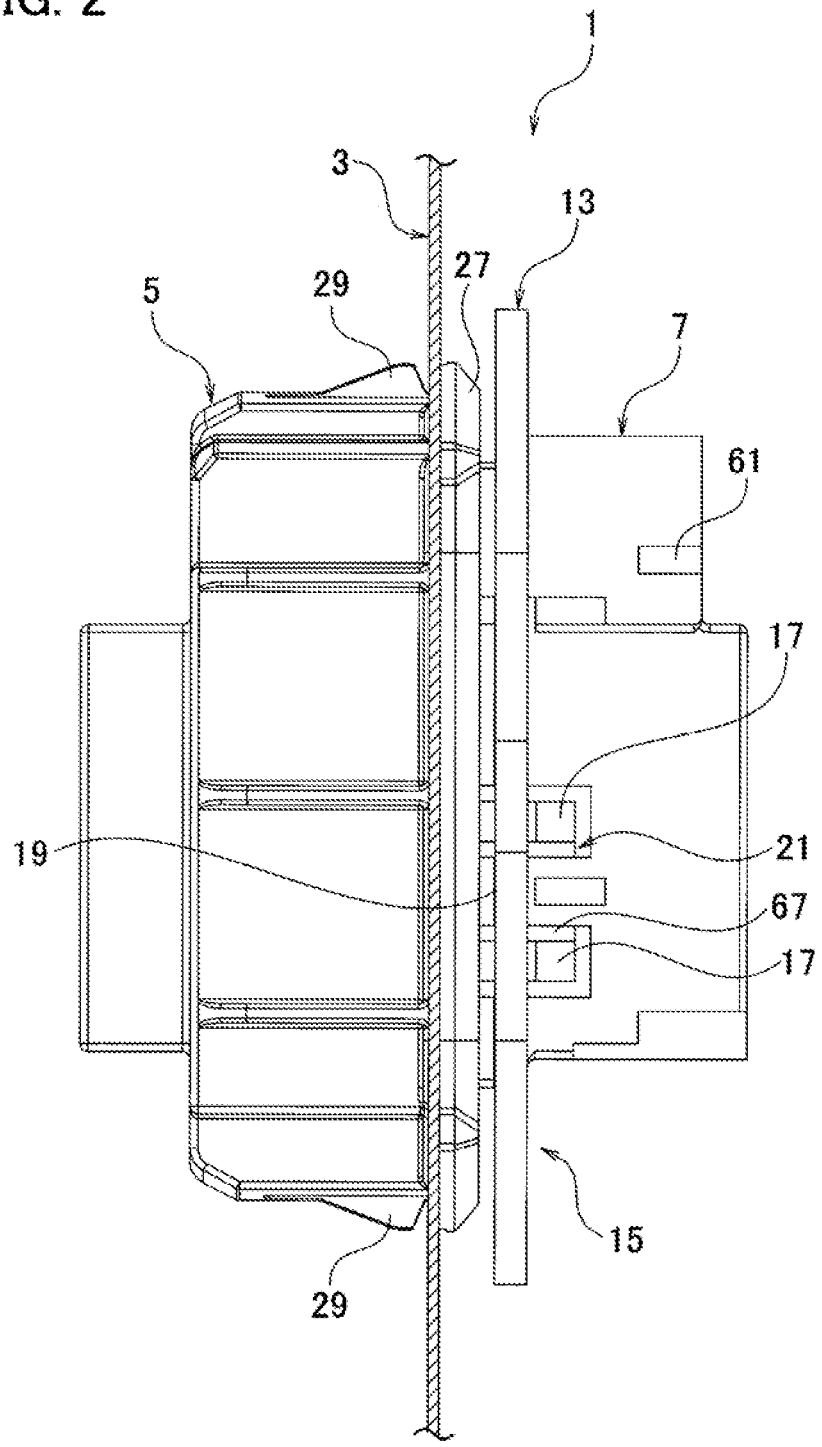
FIG. 2 is a side view of the connector, illustrated in FIG. 1, from which a grommet is detached.

A connector according to an embodiment of the present disclosure will be described with FIGS. 1 to 14.

A connector 1 according to the present embodiment includes: a panel 3; a first housing 5 assembled to the panel 3; a second housing 7 fittable to the first housing 5; a grommet 11 covering the outer circumference of the second housing 7, the grommet 11 having a lip 9 to be brought into close contact with the panel 3; a flange 13 arranged movably on the outer circumference of the second housing 7, the flange 13 being assembled with an adjacent portion to the lip 9 in the grommet 11, the flange 13 being regulated in movement with respect to the second housing 7 with the lip 9 away from the panel 3; and a fitting detection mechanism 15 enabling the flange 13 to move toward the panel 3 and enabling the lip 9 to come in close contact with the panel 3, with the first housing 5 and the second housing 7 fitting normally together.

An engaging portion 17 and an engaged portion 19 are provided between the second housing 7 and the flange 13, the engaging portion 17 being deformable, the engaged portion 19 engaging with the engaging portion 17, the engaged portion 19 regulating the movement of the flange 13 with respect to the second housing 7.

The fitting detection mechanism 15 has a releasing member 21 that deforms the engaging portion 17 to release the engagement between the engaging portion 17 and the engaged portion 19, with the first housing 5 and the second housing 7 fitting normally together.

Furthermore, the releasing member 21 is arranged movably between the first housing 5 and the second housing 7, and moves due to fitting of the first housing 5 and the second housing 7.

As illustrated in FIGS. 1 to 14, the panel 3 is arranged, for example, at a door of a vehicle. A region to be subjected to water is on the side of one face of the panel 3, and a region not to be subjected to water, such as an indoor region, is on the side of the other face of the panel 3.

Figure 3:
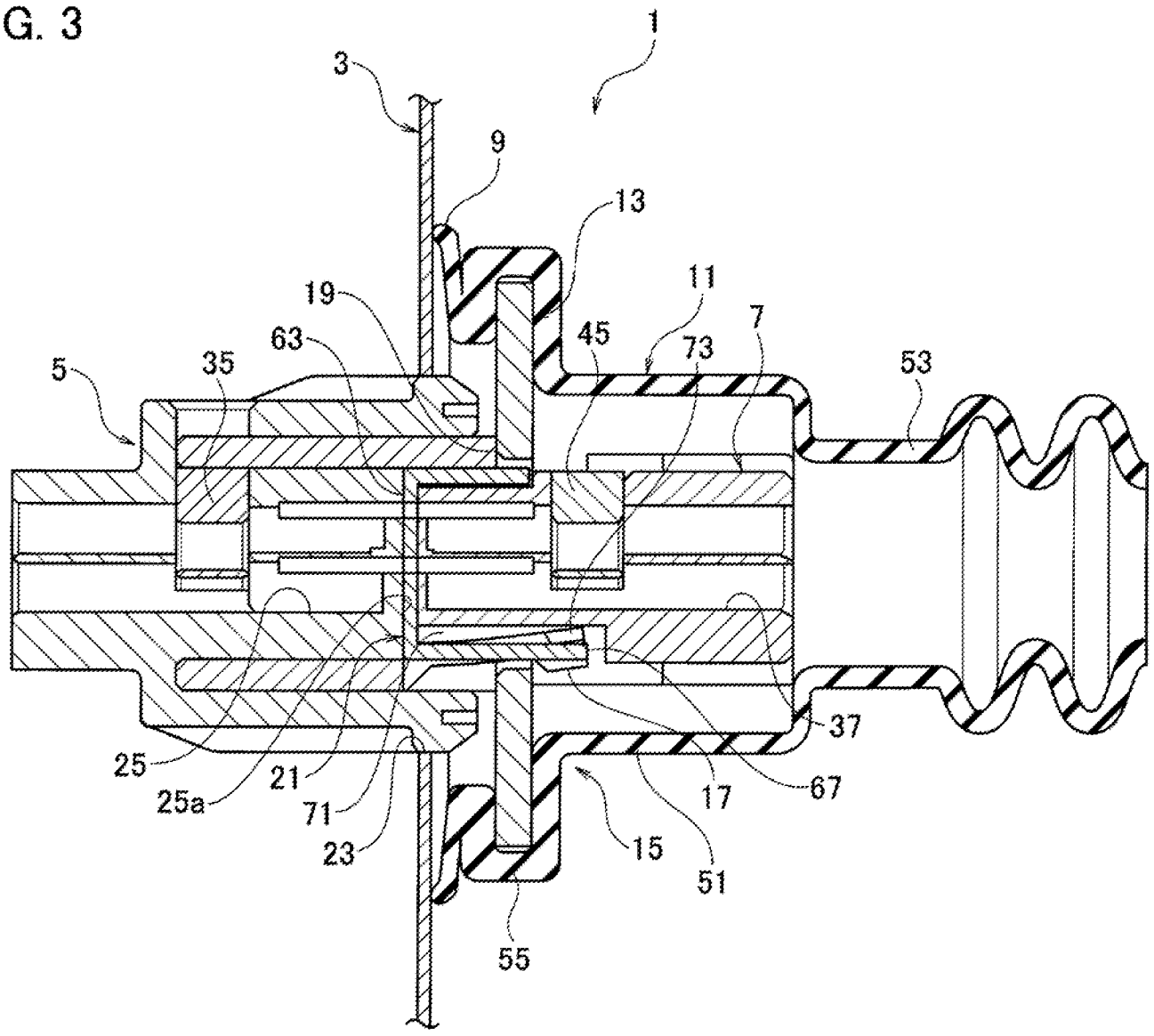
FIG. 3 is a sectional view of the connector illustrated in FIG. 1.

With respect to the panel 3, the first housing 5 is arranged in the region not to be subjected to water and the second housing 7 is arranged in the region to be subjected to water (refer to FIG. 3).

The panel 3 as above is provided with a hole for assembly 23 therethrough, and the first housing 5 is assembled to the hole for assembly 23.

Figure 7:
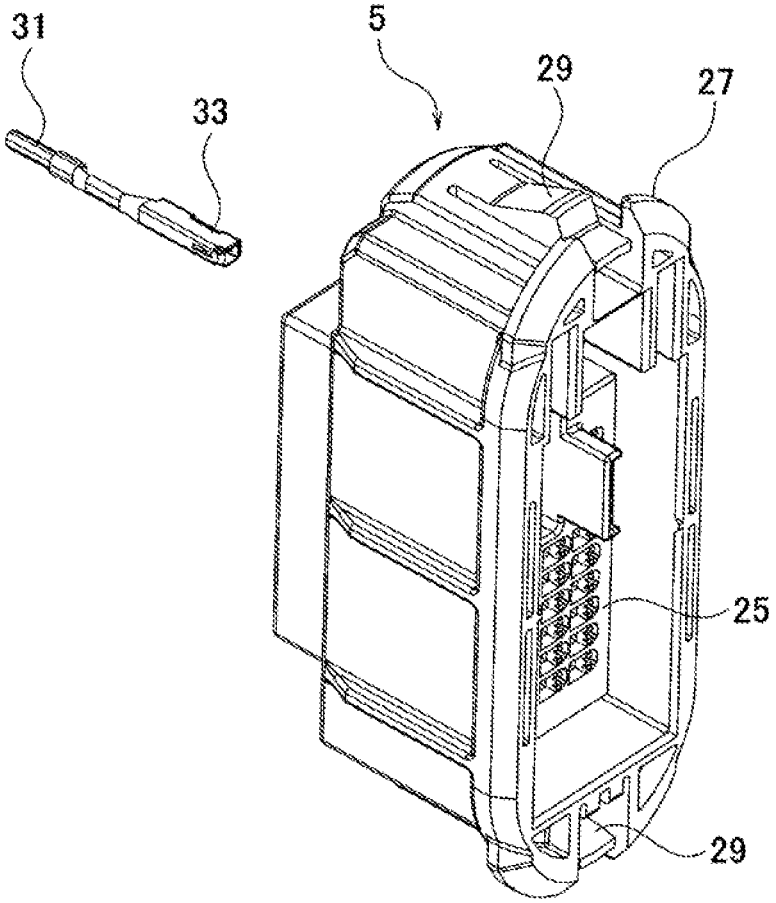
FIG. 7 is a perspective view of a first terminal and the first housing of the connector according to the embodiment of the present disclosure.
Figure 8:
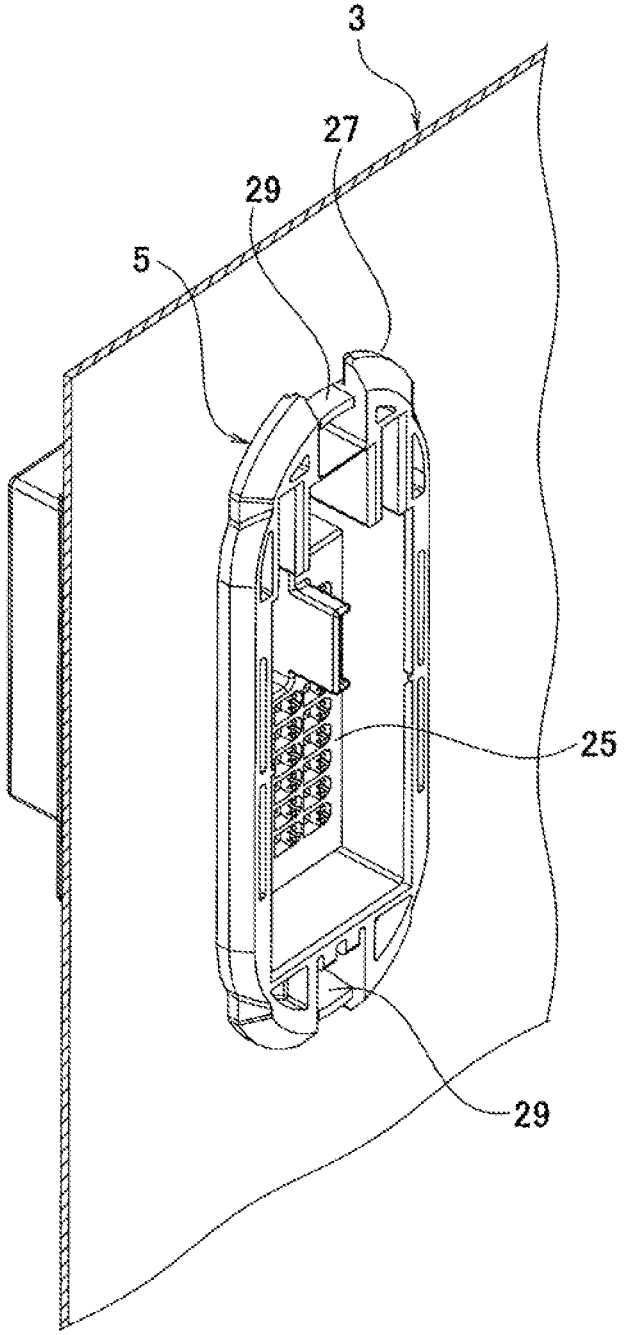
FIG. 8 is a perspective view of the first housing of the connector according to the embodiment of the present disclosure, the first housing being assembled to a panel.
Figure 9:
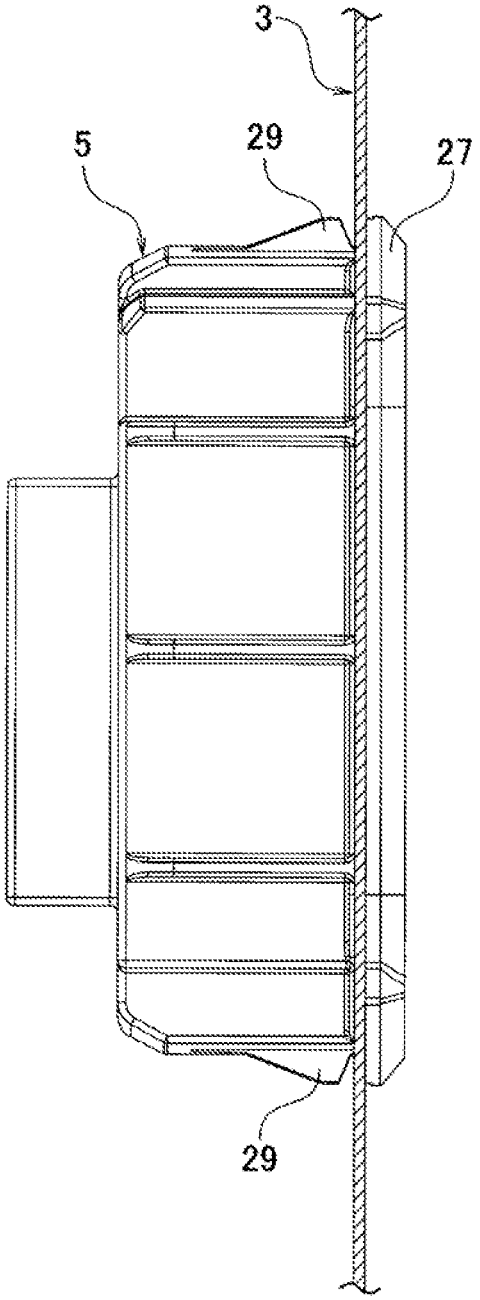
FIG. 9 is a side view of the first housing of the connector according to the embodiment of the present disclosure, the first housing being assembled to the panel.

The first housing 5 made of an insulating material, such as synthetic resin, includes a terminal housing 25, a panel attachment 27, and a locking portion 29 (refer to FIG. 7).

For the terminal housing 25, inside the first housing 5, a plurality of terminal housings 25 extending in the direction of fitting with the second housing 7, is provided in the width and height directions.

Each terminal housing 25 houses a first terminal 33 that is a female terminal having a boxy connection electrically connected with the end portion of a cable 31.

Note that each terminal housing 25 is provided internally with a spacer 35 and a locking lance (not illustrated) that engages with the first terminal 33, for prevention of the first terminal 33 from coming out of the terminal housing 25.

The panel attachment 27 is formed in a flange shape on the outer circumference on the near side of the first housing 5 to the panel 3. The outer diameter of the panel attachment 27 is set larger than the inner diameter of the hole for assembly 23 of the panel 3.

An opposite portion of the first housing 5 to the panel attachment 27 is inserted into the hole for assembly 23 of the panel 3, so that the panel attachment 27 abuts on the edge portion of the hole for assembly 23, resulting in prevention of the first housing 5 from coming out of the hole for assembly 23.

The locking portion 29 is provided deformably on each side in the height direction of the first housing 5. With the first housing 5 inserted in the hole for assembly 23 of the panel 3, the locking portions 29 are opposed to the panel attachment 27 across the panel 3.

One of the locking portions 29 engages with the edge portion of the hole for assembly 23 due to restoring force after deformation of the locking portion 29 due to insertion of the one side in the height direction of the first housing 5 into the hole for assembly 23 of the panel 3. The other locking portion 29 engages with the edge portion of the hole for assembly 23 due to restoring force after deformation of the locking portion 29 due to insertion of the other side in the height direction of the first housing 5 into the hole for assembly 23 of the panel 3.

Due to such engagement of the locking portions 29 with the hole for assembly 23 of the panel 3, the first housing 5 is assembled to the panel 3. Thus, the first housing 5 remains on standby on the panel 3 before fitting with the second housing 7 (refer to FIGS. 8 and 9).

Figure 10:
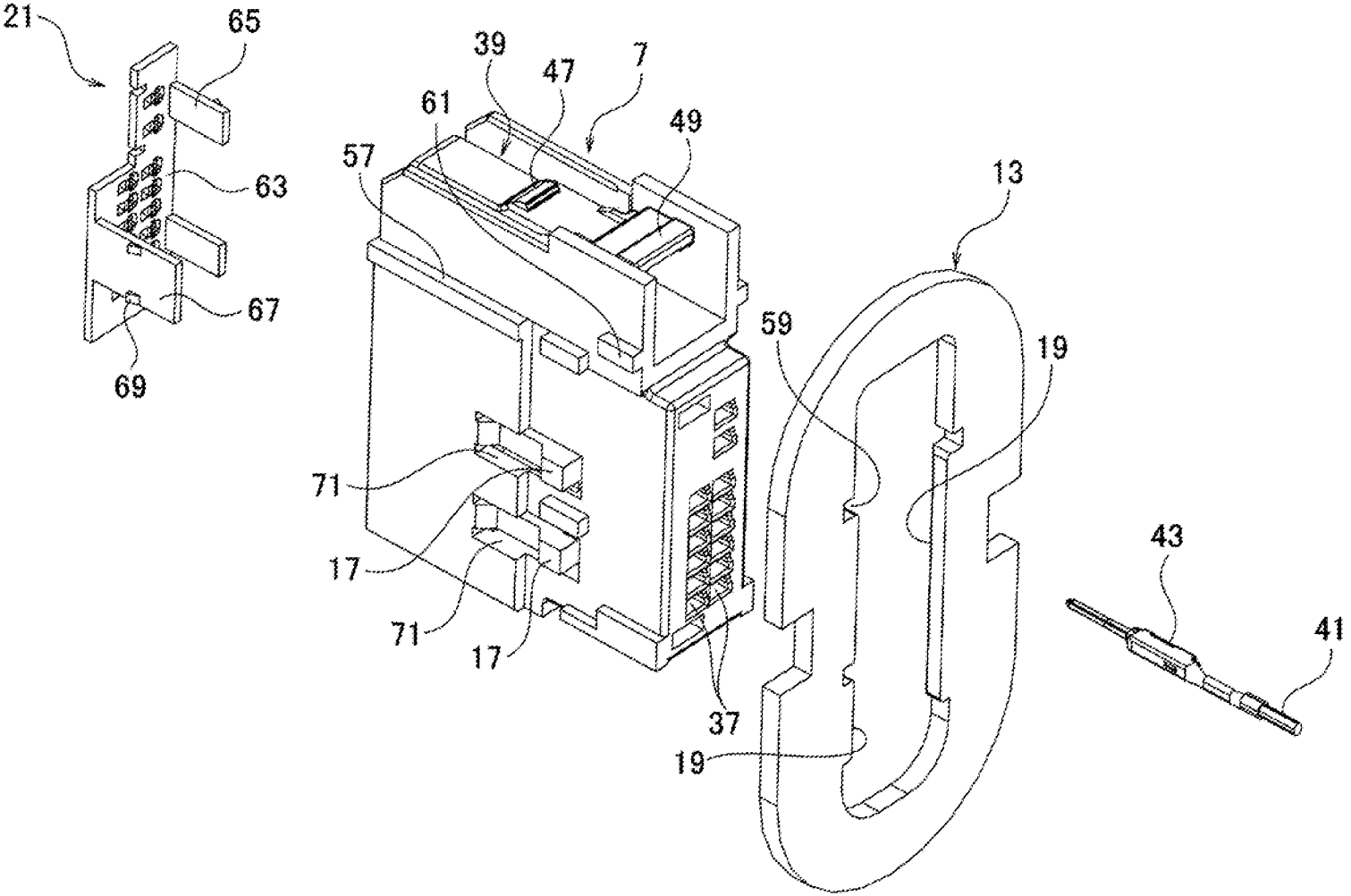
FIG. 10 is a perspective view of a flange, a releasing member, a second terminal, and the second housing of the connector according to the embodiment of the present disclosure.
Figure 11:
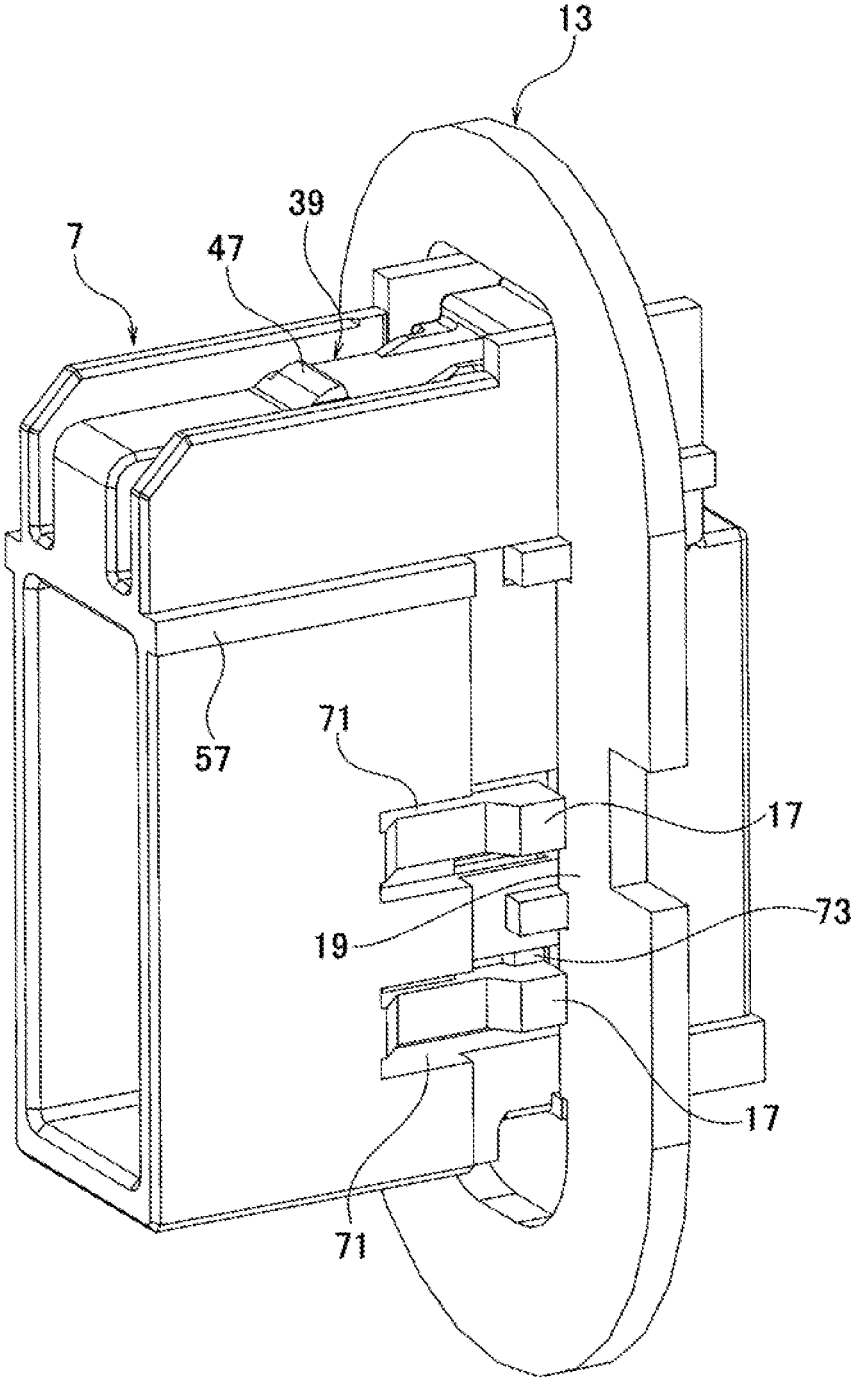
FIG. 11 is a perspective view of the members, illustrated in FIG. 10, assembled together.
Figure 12:
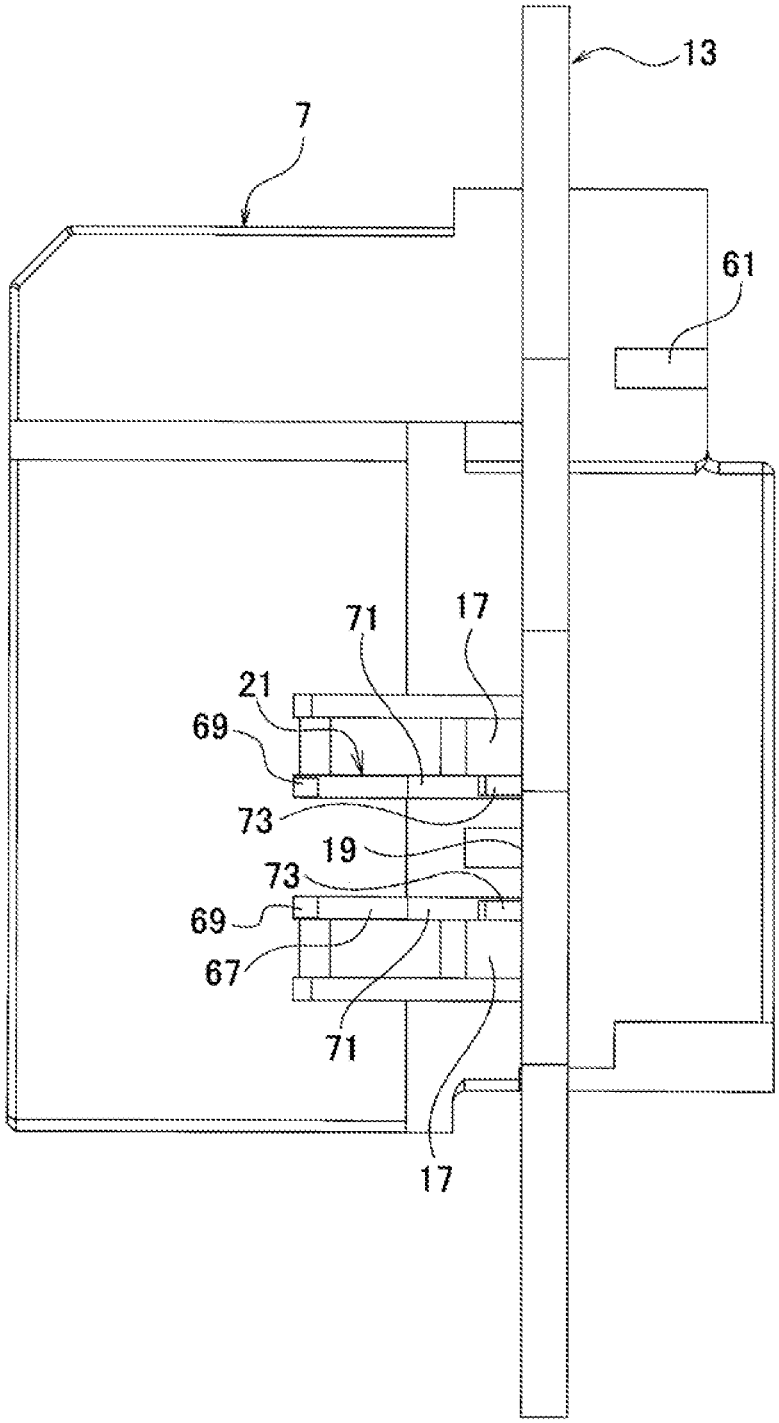
FIG. 12 is a side view of the flange assembled to the second housing of the connector according to the embodiment of the present disclosure.
Figure 13:
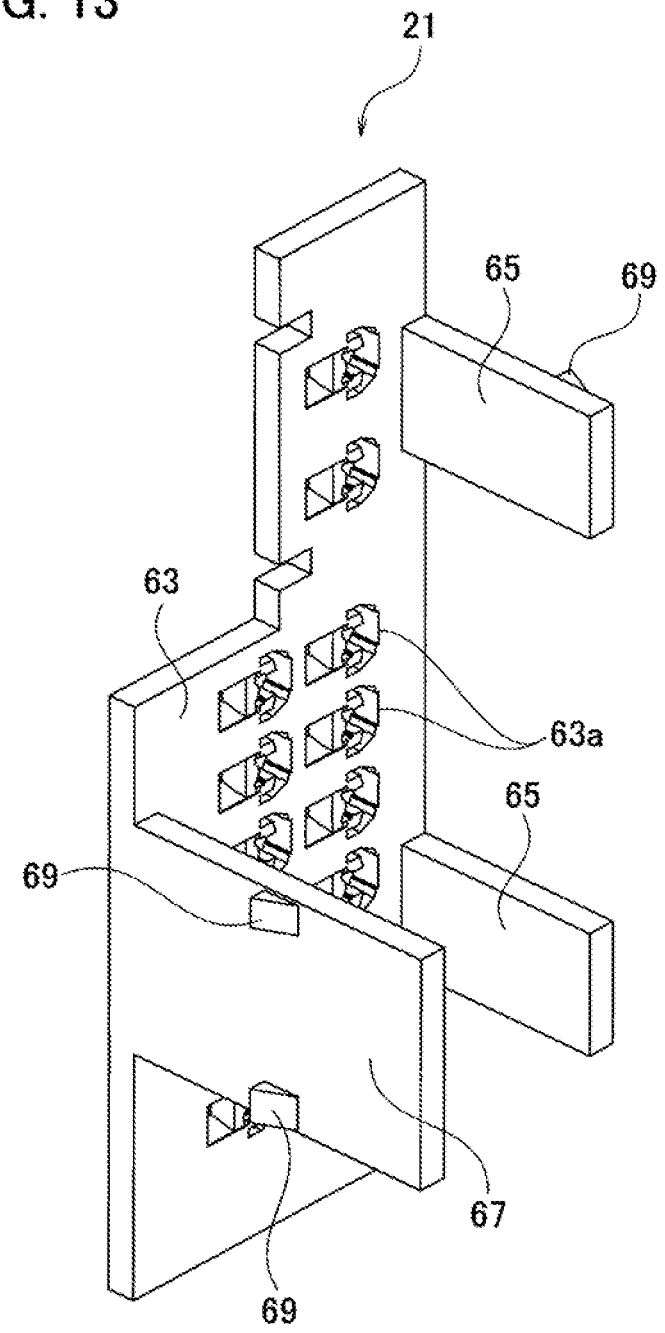
FIG. 13 is a perspective view of the releasing member of the connector according to the embodiment of the present disclosure.
Figure 14:
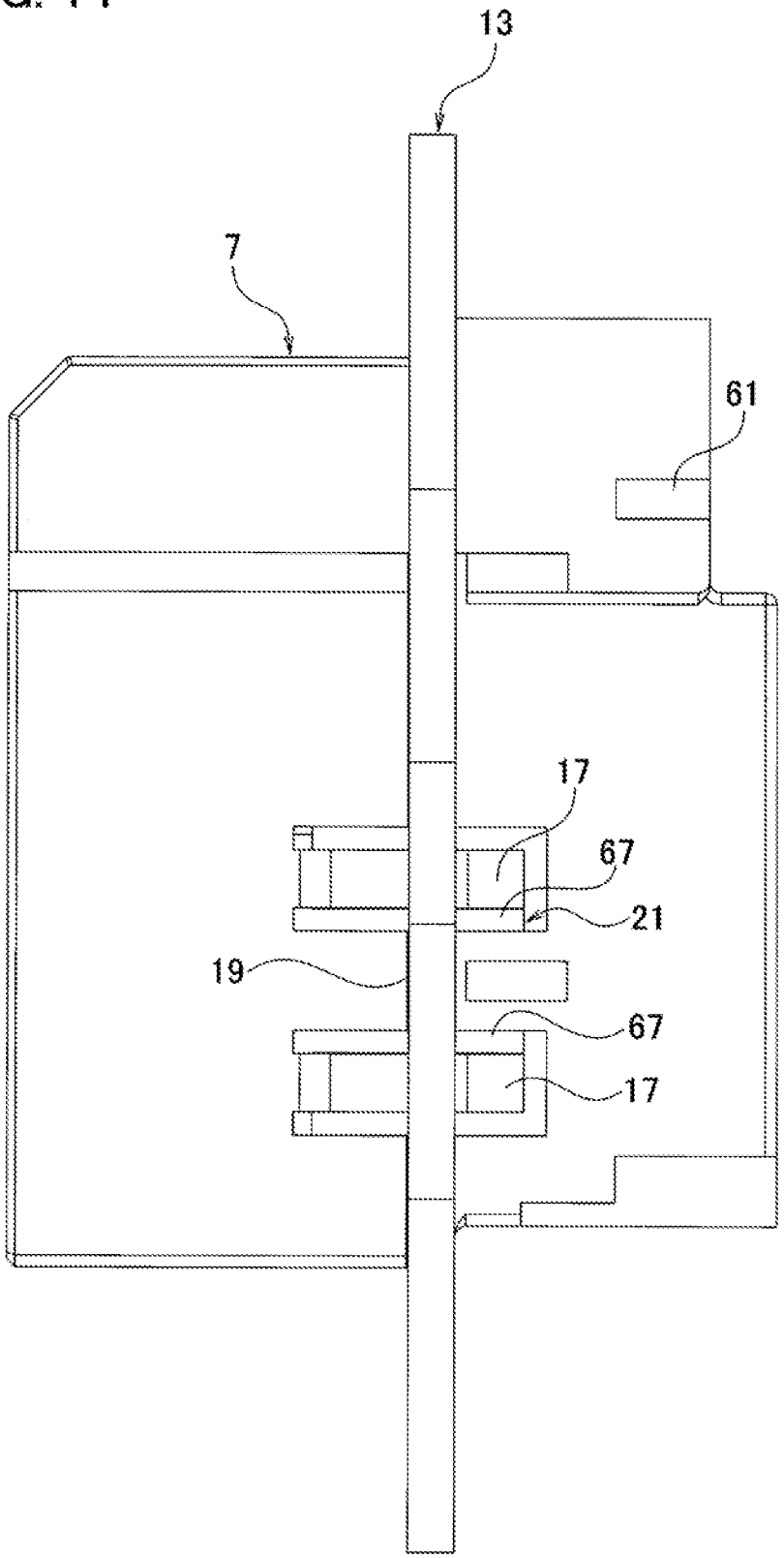
FIG. 14 is a side view of the flange and the releasing member assembled to the second housing of the connector according to the embodiment of the present disclosure, the flange having been moved due to movement of the releasing member.

The second housing 7 made of an insulating material, such as synthetic resin, includes a terminal housing 37 and a lock arm 39 (refer to FIG. 10).

For the terminal housing 37, inside the second housing 7, a plurality of terminal housings 37 extending in the direction of fitting with the first housing 5, is provided in the width and height directions.

Each terminal housing 37 houses a second terminal 43 that is a male terminal having a tabular connection electrically connected with the end portion of a cable 41.

Note that each terminal housing 37 is provided internally with a spacer 45 and a locking lance (not illustrated) that engages with the second terminal 43, for prevention of the second terminal 43 from coming out of the terminal housing 37 (refer to FIG. 3).

The lock arm 39 is provided deformably on one side in the height direction of the second housing 7, and includes a lock portion 47 and an operation portion 49.

The lock portion 47 protrudes from the central portion of the lock arm 39, and engages with a locked portion (not illustrated) provided at the first housing 5 due to restoring force after deformation of the lock arm 39, with the first housing 5 and the second housing 7 fitting together.

The engagement between the lock portion 47 and the locked portion regulates movement in the direction of fitting release between the first housing 5 and the second housing 7, so that the fitting state between the first housing 5 and the second housing 7 can be retained.

The operation portion 49 is provided on the free-end side of the lock arm 39. Giving the operation portion 49 a downward press causes the lock arm 39 to deform, resulting in release of the engagement between the lock portion 47 and the locked portion.

The release of the engagement between the lock portion 47 and the locked portion by the operation portion 49 enables detachment of the second housing 7 from the first housing 5.

Figure 4:
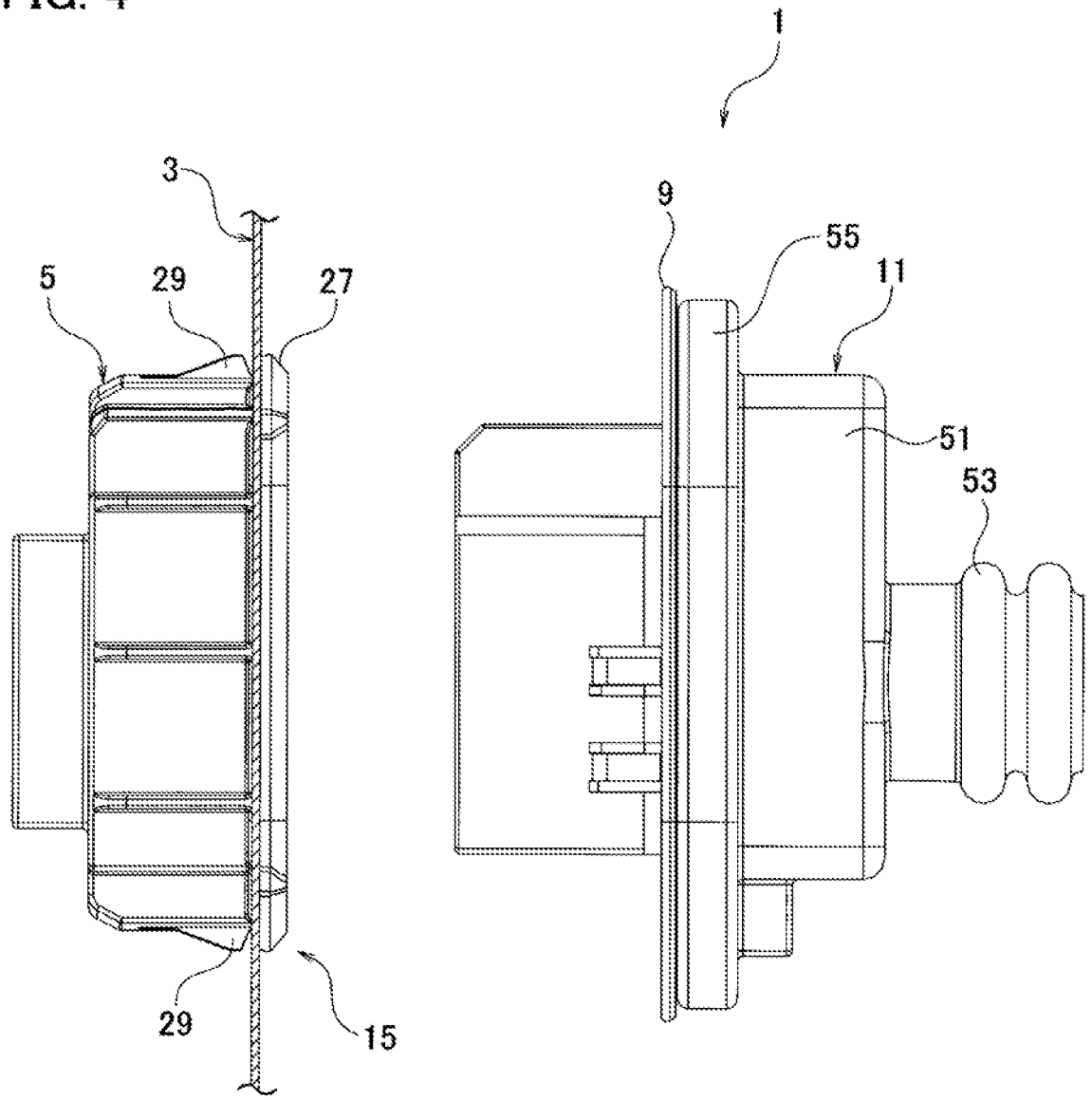
FIG. 4 is a side view of the connector according to the embodiment of the present disclosure before fitting of the first housing and the second housing.
Figure 5:
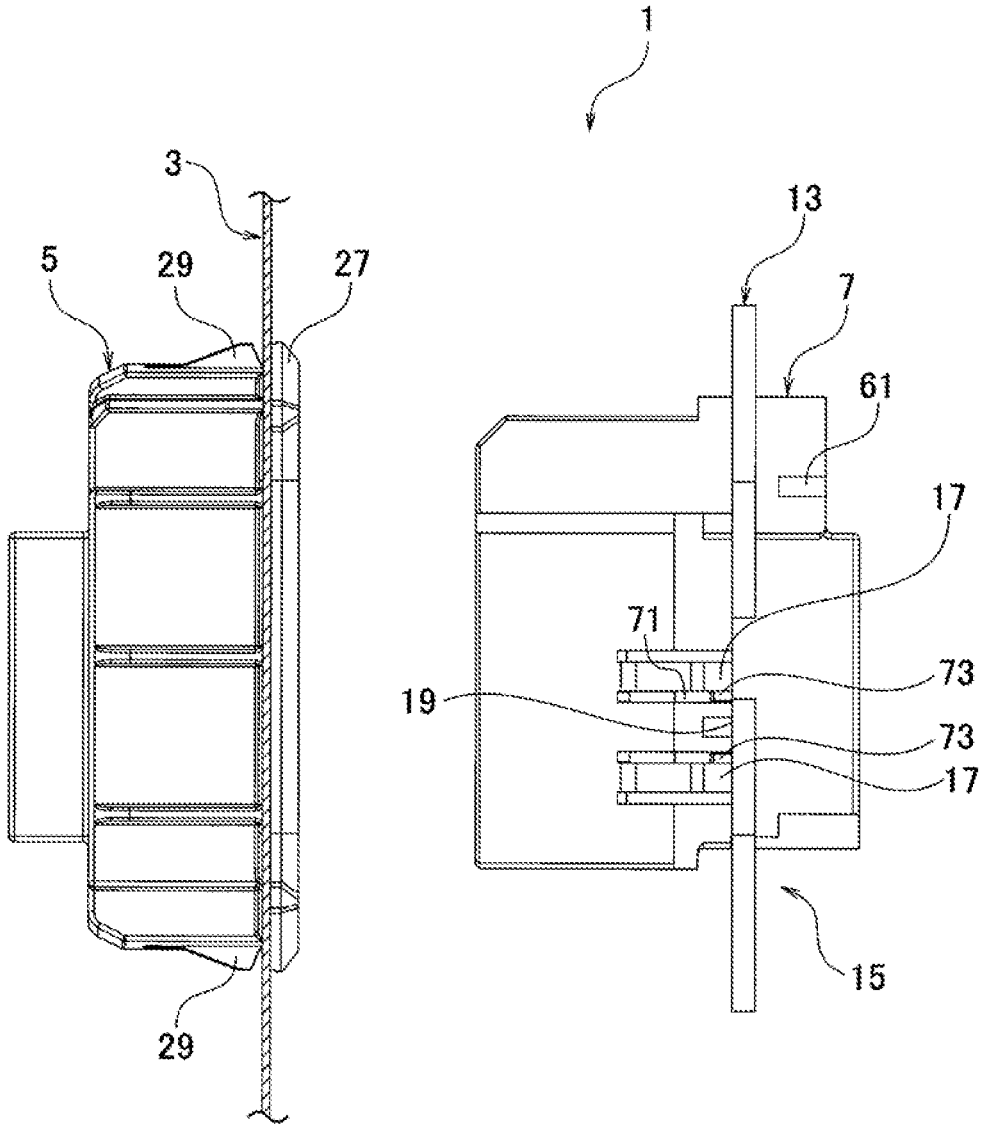
FIG. 5 is a side view of the connector, illustrated in FIG. 4, from which the grommet is detached.
Figure 6:
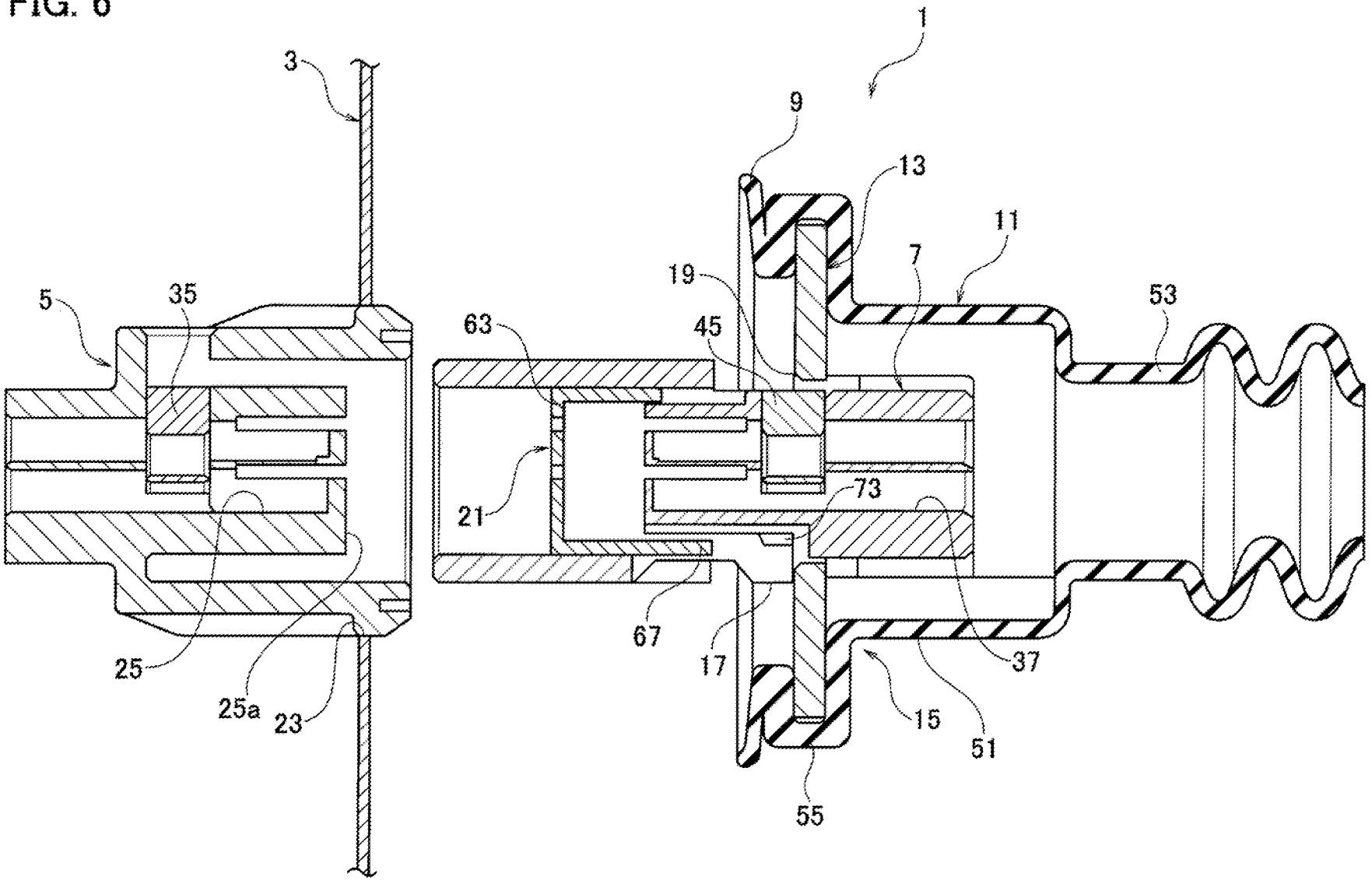
FIG. 6 is a sectional view of the connector illustrated in FIG. 4.

With the first housing 5 assembled to the panel 3, the second housing 7 as above fits with the first housing 5, resulting in electrical connection of the first terminals 33 and the second terminals 43 (refer to FIGS. 4 and 6).

As above, the second housing 7 fittable to the first housing 5 is arranged in the region to be subjected to water, and the outer circumference of the second housing 7 is covered with the grommet 11 for waterproofing.

The grommet 11 made of an elastic material, such as rubber, includes: a main body 51 formed in a tubular shape so as to house the second housing 7; an extended portion 53 provided on the one-end side of the main body 51; the lip 9 provided on the other-end side of the main body 51; and a mounting portion 55 provided adjacently to the lip 9 (refer to FIG. 3).

The extended portion 53 extends in a tubular shape from one side of the main body 51 in the direction away from the panel 3. The plurality of cables 41 extended from the second housing 7 is inserted through the extended portion 53.

The extended portion 53 is in closely contact with the outer circumference of the plurality of cables 41 inserted therethrough, and prevents, for example, water from flowing into the main body 51 along the plurality of cables 41, resulting in protection of the second housing 7 housed in the main body 51 against the water.

The lip 9 is provided annularly and deformably in elasticity on the other side of the main body 51. The lip 9 is brought into close contact with the surface of the panel 3, with the first housing 5 and the second housing 7 fitting normally together.

The outer diameter of the lip 9 is set lager than the inner diameter of the hole for assembly 23 of the panel 3 and the outer diameter of the panel attachment 27 of the first housing 5. Close contact of the lip 9 with the surface of the panel 3 protects the second housing 7 housed in the main body 51 against water, and additionally prevents, for example, water from flowing through the hole for assembly 23 of the panel 3 from the side of the second housing 7 to the side of the first housing 5, resulting in protection of the side of the first housing 5 with respect to the panel 3, against the water.

The mounting portion 55 is provided adjacently to the lip 9 of the main body 51 on a side opposite to the panel 3. The mounting portion 55 is annular and has an outer diameter larger than that of the second housing 7. The mounting portion 55 is provided internally with circumferentially consecutive grooves.

The mounting portion 55 is assembled with the flange 13 assembled to the outer circumference of the second housing 7 such that the flange 13 engages with the grooves in close contact.

The flange 13 made of an insulating material, such as synthetic resin, is annular and has an inner diameter equivalent to or slightly larger than the outer diameter of the second housing 7.

The flange 13 is assembled, movably in the direction of fitting between the first housing 5 and the second housing 7, to the outer circumference of the second housing 7.

Note that the inner circumference of the flange 13 is provided with a guide recess 59 for engagement with a guide rail 57 protruding from each side wall of the second housing 7 such that movement of the flange 13 to the second housing 7 is guided (refer to FIG. 10).

The flange 13 as above is assembled to the outer circumference of the second housing 7 such that the lip 9 of the grommet 11 is arranged apart from the panel 3 with the first housing 5 and the second housing 7 fitting together.

The position of assembly of the flange 13 to the second housing 7 is retained by engagement of the engaging portion 17 provided between the second housing 7 and the flange 13 with the engaged portion 19.

For the engaging portion 17, a pair of engaging portions 17 in the height direction of the second housing 7 is provided deformably at one side wall of the second housing 7.

The engaged portion 19 is provided on a side face of the portion opposed to the engaging portions 17, on the inner circumference of the flange 13.

Note that a protrusion 61 protrudes from a portion of the second housing 7, opposed to the opposite face to the engaged portion 19, resulting in regulation of movement of the flange 13 in the direction of fitting release between the first housing 5 and the second housing 7.

The engaging portions 17 and the engaged portion 19 engage together due to assembly of the flange 13 to the outer circumference of the second housing 7, resulting in regulation of movement of the flange 13 in the direction of fitting between the first housing 5 and the second housing 7. Thus, the flange 13 is retained at the provisional locked position of the flange 13 to the second housing 7, the provisional locked position enabling the lip 9 of the grommet 11 to be apart from the panel 3.

Assembly of the mounting portion 55 of the grommet 11 to the flange 13 retained at the provisional locked position as above, causes the lip 9 of the grommet 11 to be retained apart from the panel 3 with the first housing 5 and the second housing 7 fitting together.

The flange 13 retained at the provisional locked position is allowed to move toward the panel 3 by the fitting detection mechanism 15 with the first housing 5 and the second housing 7 fitting normally together. Movement of the flange 13 causes the lip 9 of the grommet 11 to come in close contact with the surface of the panel 3.

With the first housing 5 and the second housing 7 not fitting normally together, the fitting detection mechanism 15 does not allow the flange 13 to move with respect to the second housing 7, and notifies, for example, an operator that the first housing 5 and the second housing 7 have not fitted normally together.

Meanwhile, with the first housing 5 and the second housing 7 fitting normally together, the fitting detection mechanism 15 allows the flange 13 to move with respect to the second housing 7, and notifies, for example, an operator that the first housing 5 and the second housing 7 have fitted normally together.

As above, on the basis of whether the flange 13 is movable with respect to the second housing 7, the fitting detection mechanism 15 is capable of detecting the fitting state between the first housing 5 and the second housing 7, easily. The second housing 7 does not need to be pulled in the direction away from the first housing 5, and thus detection of the fitting state is not troublesome.

The fitting detection mechanism 15 as above has the releasing member 21 arranged movably between the first housing 5 and the second housing 7 (refer to FIG. 3).

The releasing member 21 made of an insulating material, such as synthetic resin, has a U shape and is housed movably in the direction of fitting between the first housing 5 and the second housing 7, inside the second housing 7. The releasing member 21 includes an abutment piece 63, an engagement piece 65, and a releasing piece 67 (refer to FIGS. 10 and 13).

The abutment piece 63 that is flat is provided with a plurality of through holes 63*a* through which the tabular connections of the second terminals 43 can be inserted, in accordance with the plurality of terminal housings 25 and the plurality of terminal housings 37 provided, respectively, to the first housing 5 and the second housing 7.

The abutment piece 63 having been housed in the second housing 7, is arranged apart from the end face of the terminal housings 37.

At the time of fitting of the first housing 5 and the second housing 7, the abutment piece 63 as above abuts on an end face 25*a* of the terminal housings 25 of the first housing 5, and then the end face 25*a* moves the releasing member 21 toward the terminal housings 37 of the second housing 7 (refer to FIG. 3).

For the engagement piece 65, two engagement pieces 65 extending from one side of the abutment piece 63 toward the terminal housings 37 of the second housing 7, are provided in the height direction of the second housing 7.

A guide protrusion 69 protruding on the near side of each engagement piece 65 to an inner wall of the second housing 7, engages with a guide groove 71 provided on the one side wall of the second housing 7 (refer to FIG. 10).

Due to the engagement between the guide protrusion 69 of each engagement piece 65 and the guide groove 71, movement of the releasing member 21 is guided, and additionally the arrangement position of the releasing member 21 is retained to the second housing 7.

The releasing piece 67 extending from another side of the abutment piece 63 toward the terminal housings 37 of the second housing 7, has a width equivalent to or slightly smaller than the space between the pair of engaging portions 17, 17.

Note that two guide protrusions 69 protruding on the near side of the releasing piece 67 to the other inner wall of the second housing 7, engage with two guide grooves 71 provided on the other side wall of the second housing 7.

At the time of movement of the releasing member 21 due to abutting of the first housing 5 and the abutment piece 63, the releasing piece 67 is inserted between the engaging portions 17, 17. Respective engagement protrusions 73, 73 protrude inside from the engaging portions 17, 17. The respective engagement protrusions 73, 73 are integrally formed with the engaging portions 17, 17.

When the first housing 5 and the second housing 7 are brought into the normal fitting state, the releasing piece 67 inserted between the engaging portions 17, 17 runs on the respective engagement protrusions 73, 73 provided at the engaging portions 17, 17. As a result, the releasing piece 67 deforms the engaging portions 17, 17 inward with respect to the second housing 7.

Due to the deformation of the engaging portions 17 by the releasing piece 67, the engagement between the engaging portions 17 and the engaged portion 19 of the flange 13 is released, so that the flange 13 can move toward the panel 3 with respect to the second housing 7.

Meanwhile, when the first housing 5 and the second housing 7 are in an incomplete fitting state insufficient to the normal fitting state, the releasing piece 67 does not reach the respective engagement protrusions 73, 73 of the engaging portions 17, 17.

Thus, the engaging portions 17, 17 do not deform, resulting in retention of the engagement between the engaging portions 17, 17 and the engaged portion 19. Thus, the flange 13 is immovable toward the panel 3 with respect to the second housing 7.

As above, movement of the releasing member 21 corresponding to the fitting state between the first housing 5 and the second housing 7, enables easy determination of whether the flange 13 is movable. As a result, the fitting state between the first housing 5 and the second housing 7 can be detected reliably.

Note that, after the flange 13 moves such that the lip 9 comes in close contact with the panel 3, the flange 13 is retained at the normal locked position to the second housing 7 (position retaining the lip 9 in close contact with the panel 3) by engagement means (not illustrated) provided between the second housing 7 and the flange 13.

For assembly of the connector 1 as above, first, the first housing 5 is assembled to the panel 3, the flange 13 is assembled to the second housing 7, and the grommet 11 is mounted on the flange 13.

Next, the second housing 7 is fitted to the first housing 5, and then the flange 13 (mounting portion 55 of the grommet 11) is pressed toward the panel 3.

When the flange 13 moves, the lip 9 is brought into close contact with the panel 3 by movement of the flange 13. When the flange 13 does not move, the second housing 7 is fitted to the first housing 5 again. Then, the lip 9 is brought into close contact with the panel 3 by movement of the flange 13, and the assembly is completed.

As described above, the connector 1 includes the fitting detection mechanism 15 that enables the flange 13 to move toward the panel 3 and enables the lip 9 to come in close contact with the panel 3, with the first housing 5 and the second housing 7 fitting normally together. Thus, the flange 13 is movable toward the panel 3 in the normal fitting state between the first housing 5 and the second housing 7, and the flange 13 is immovable toward the panel 3 with the first housing 5 and the second housing 7 not fitting normally together.

Therefore, the connector 1 as above enables detection of the fitting state between the first housing 5 and the second housing 7 based on whether the flange 13 moves. Thus, the fitting state between the first housing 5 and the second housing 7 can be easily detected.

The fitting detection mechanism 15 has the releasing member 21 that deforms the engaging portions 17 to release the engagement between the engaging portions 17 and the engaged portion 19, with the first housing 5 and the second housing 7 fitting normally together. Thus, movement of the flange 13 with respect to the second housing 7 can be reliably controlled on the basis of whether the engagement between the engaging portions 17 and the engaged portion 19 is released by the releasing member 21.

Furthermore, the releasing member 21 is arranged movably between the first housing 5 and the second housing 7, and moves due to fitting of the first housing 5 and the second housing 7. Thus, the releasing member 21 can reliably release the engagement between the engaging portions 17 and the engaged portion 19, in accordance with the fitting state between the first housing 5 and the second housing 7.

Note that, in the connector according to the embodiment of the present disclosure, the releasing member that is formed separately from the first housing or the second housing is arranged movably. However, instead of this, the releasing member may be integrally formed with the first housing or the second housing, and may release the engagement between the engaging portions and the engaged portion in the normal fitting state between the first housing and the second housing.

The engaging portions are provided at the second housing and the engaged portion is provided at the flange. However, instead of this, the engaging portions may be provided at the flange and the engaged portion may be provided at the second housing.

What is claimed is:

1. A connector comprising:

a first housing assembled to a panel;

a second housing fittable to the first housing;

a grommet covering an outer circumference of the second housing, the grommet having a lip adherable to the panel;

a flange arranged movably on the outer circumference of the second housing, the flange being assembled with an adjacent portion to the lip in the grommet, the flange being regulable in movement with respect to the second housing together with the lip away from the panel; and a fitting detection mechanism enabling the flange to move toward the panel and enabling the lip to come in close contact with the panel, with the first housing and the second housing fitting normally together.

2. The connector according to claim 1, wherein an engaging portion and an engaged portion are provided between the second housing and the flange, the engaging portion being deformable, the engaged portion engaging with the engaging portion, the engaged portion regulating the movement of the flange with respect to the second housing, and the fitting detection mechanism has a releasing member that deforms the engaging portion to release the engagement between the engaging portion and the engaged portion, with the first housing and the second housing fitting normally together.

3. The connector according to claim 2, wherein the releasing member is arranged movably between the first housing and the second housing, and moves due to fitting of the first housing and the second housing.

* * * * *